US006550432B2

(12) United States Patent
Takahashi et al.

(10) Patent No.: US 6,550,432 B2
(45) Date of Patent: Apr. 22, 2003

(54) VEHICLE MULTI-CYLINDER ENGINE

(75) Inventors: Masayuki Takahashi, Saitama (JP); Toshihiro Akiwa, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/000,961

(22) Filed: Dec. 4, 2001

(65) Prior Publication Data

US 2002/0066426 A1 Jun. 6, 2002

(30) Foreign Application Priority Data

Dec. 4, 2000 (JP) ..... 2000-369035

(51) Int. Cl.[7] ..... F10L 1/34
(52) U.S. Cl. ..... 123/90.15
(58) Field of Search ..... 123/90.15, 90.16, 123/90.17, 90.18

(56) References Cited

U.S. PATENT DOCUMENTS 5,423,295 A * 6/1995 Murata et al. ..... 123/90.16
6,289,859 B1 * 9/2001 Fujii et al. ..... 123/90.15

FOREIGN PATENT DOCUMENTS

JP 2741492 1/1998

* cited by examiner

*Primary Examiner*—Thomas Denion
*Assistant Examiner*—Ching Chang
(74) *Attorney, Agent, or Firm*—Arent Fox Kintner Plotkin & Kahn, PLLC

(57) ABSTRACT

A vehicle multi-cylinder engine in which a plurality of banks each comprising a cylinder row portion and a cylinder head and set at an angle relative to each other are disposed so as to be offset from each other in an axial direction of a crankshaft, and in which valve operating characteristics changing mechanisms for changing the operating characteristics of engine valves in response to oil pressure control by an oil pressure control valve are incorporated in the valve trains on the cylinder head of at least either of the respective banks. An oil pressure control valve is disposed in a space produced between end portions of adjacent banks at one ends thereof along an axial direction of a crankshaft as the respective banks are offset from each other and is attached to at least one cylinder head.

22 Claims, 13 Drawing Sheets

VEHICLE MULTI-CYLINDER ENGINE

BACKGROUND OF THE INVENTION

The present invention relates to the improvement of a vehicle multi-cylinder engine that has a plurality of banks each comprising a cylinder row portion and a cylinder head. The plurality of banks are setted at an angle relative to each other and disposed so as to be offset from each other in an axial direction of a crankshaft. The vehicle multi-cylinder engine has a valve operating characteristics changing mechanisms which changes operating characteristics of engine valves in response to oil pressure control implemented by oil pressure control valves. The oil pressure control valves are incorporated in valve trains on the cylinder head of at least one of the plurality of banks.

Conventionally, such a vehicle multi-cylinder engine is described in Japanese patent Publication No. 2741492 and the like.

In a conventional vehicle multi-cylinder engine such as above, a pair of banks disposed in a V-shape are provided integrally on an engine block. A pump body constituting part of a pump case of an oil pump is attached to an end wall of the engine block at one end thereof along the axial direction of a crankshaft. An oil pressure control valve is, in turn, attached to the pump body. These construction results in the placement of the oil pressure control valve at a position which protrudes from the engine in the axial direction of the crankshaft and the enlargement of the overall dimensions of the multi-cylinder engine. However, since both the banks are disposed so as to be offset from each other in the axial direction of the crankshaft, a vacant space should be produced between end portions of both the banks at either end of the banks in the axial direction of the crankshaft. Making effective use of such a vacant space for disposing the oil pressure control valve therein can contribute to making the vehicle multi-cylinder engine compact.

SUMMARY OF THE PRESENT INVENTION

The present invention was made in view of the situation. An object thereof is to provide a vehicle multi-cylinder engine, that an oil pressure control valve is disposed at a position and the position makes it possible to miniaturize the overall vehicle multi-cylinder engine.

With a view to attaining the object, according to the first aspect of the invention, there is provided A vehicle multi-cylinder engine comprising: a plurality of banks, each including a cylinder row portion having a plurality of cylinder bores arranged in a row and provided in an engine block, and a cylinder head connected to the cylinder row portion, wherein the plurality of banks are setted at an angle relative to each other on a projection drawing onto a plane normal to an axial direction of a crankshaft and are disposed to be offset from each other in an axial direction of the crankshaft; valve trains provided on the cylinder heads of the respective banks, for driving engine valves for the cylinder bores, respectively, to open and close; and valve operating characteristics changing mechanisms incorporated in the valve trains of at least one of the respective banks, and being adapted to change operating characteristics of the engine valves in response to oil pressure control implemented by an oil pressure control valve; wherein the oil pressure control valve is disposed in a space produced between end portions of the contiguous banks at either of ends thereof in an axial direction of the crankshaft as the banks are offset from each other and the oil pressure control valve is attached to at least one of the cylinder heads.

In the first aspect of the invention, it is preferred that the oil pressure control valve is disposed on a side face of at least one of the banks in a direction in which cylinders are arranged, and in a space produced between end portions of the contiguous banks at either of ends thereof in the axial direction of the crankshaft as the banks are offset from each other.

According to the construction of the first aspect of the invention, the space is produced between one end portion of the banks and the other contiguous banks along the axial direction of the crankshaft, because the plurality of banks dispose to be offset from each other in the axial direction of the crankshaft. Since the oil pressure control valve is disposed in the space, there is no risk of the oil pressure control valve to protrude from the engine in the axial direction of the crankshaft, whereby the miniaturization of the overall multi-cylinder engine can be attained.

According to a second aspect of the invention, there is provided a vehicle multi-cylinder engine as set forth in the first aspect of the invention, wherein the oil pressure control valve is disposed in the space which is produced at an end side of the engine and is adjoined to a transmission. According to the construction of the second aspect of the invention, since a space above the transmission is open and the oil pressure control valve is disposed so as to adjoin to the space, whereby the service of the oil pressure control valve for maintenance thereof can be facilitated.

According to a third aspect of the invention, there is provided a vehicle multi-cylinder engine as set forth in the first or second aspect of the invention, wherein the oil pressure control valve is attached to the cylinder head in a range of a width thereof. According to the construction of the third aspect of the invention, the overall multi-cylinder engine can be made more compact with the oil pressure control valve so as not to protrude sideways from the cylinder head.

According to a fourth aspect of the invention, there is provided a vehicle multi-cylinder engine as set forth in any of the first to third aspects of the invention, wherein the pair of banks are formed in a V-shape on a projection drawing onto a plane that is normal to axial direction of the crankshaft extending in a transverse direction of a vehicle, and the valve trains incorporating the valve operating characteristics changing mechanisms and the oil pressure control valve are, respectively, disposed on only the cylinder head of one bank of the banks situated on a rear side of the engine as viewed in a longitudinal direction of the vehicle.

According to the construction of the fourth aspect of the invention, when the adverse effect occurred to the oil pressure control valve by running wind while the vehicle is running, the adverse effect is suppressed to as low a level as possible by disposing the oil pressure control valve at the rear of the engine in the longitudinal direction of the vehicle. Namely, the cylinder head of the bank is disposed ahead of the oil pressure control valve to function as a wall for shielding the oil pressure control valve from the running wind. Then the reduction in temperature of hydraulic oil is suppressed, where the hydraulic oil controls the pressure, which is controlled by the oil pressure control valve. Therefore the response of the valve operating characteristics changing mechanisms is maintained high. In addition, an oil path between the valve operating characteristics changing mechanisms and the oil pressure control valve can be made shorter.

DETAILED DESCRIPTION OF THE PREFERRED EMBODIMENT

A mode for carrying out the invention will be described below based on an embodiment of the invention shown in the appended drawings.

Figure 1:
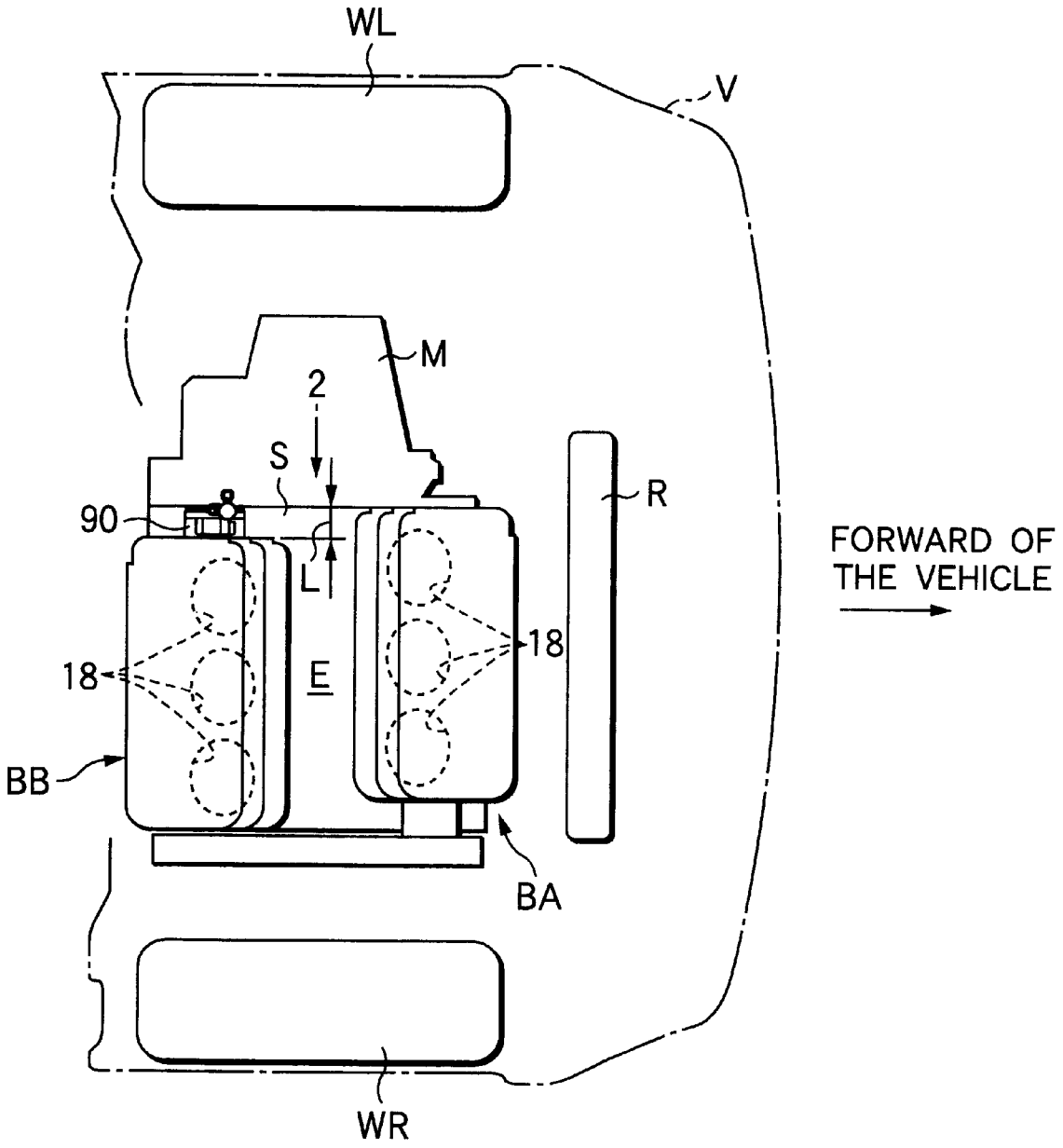
FIG. 1 is a plan view schematically showing a state in which a multi-cylinder engine is mounted on a vehicle.
Figure 2:
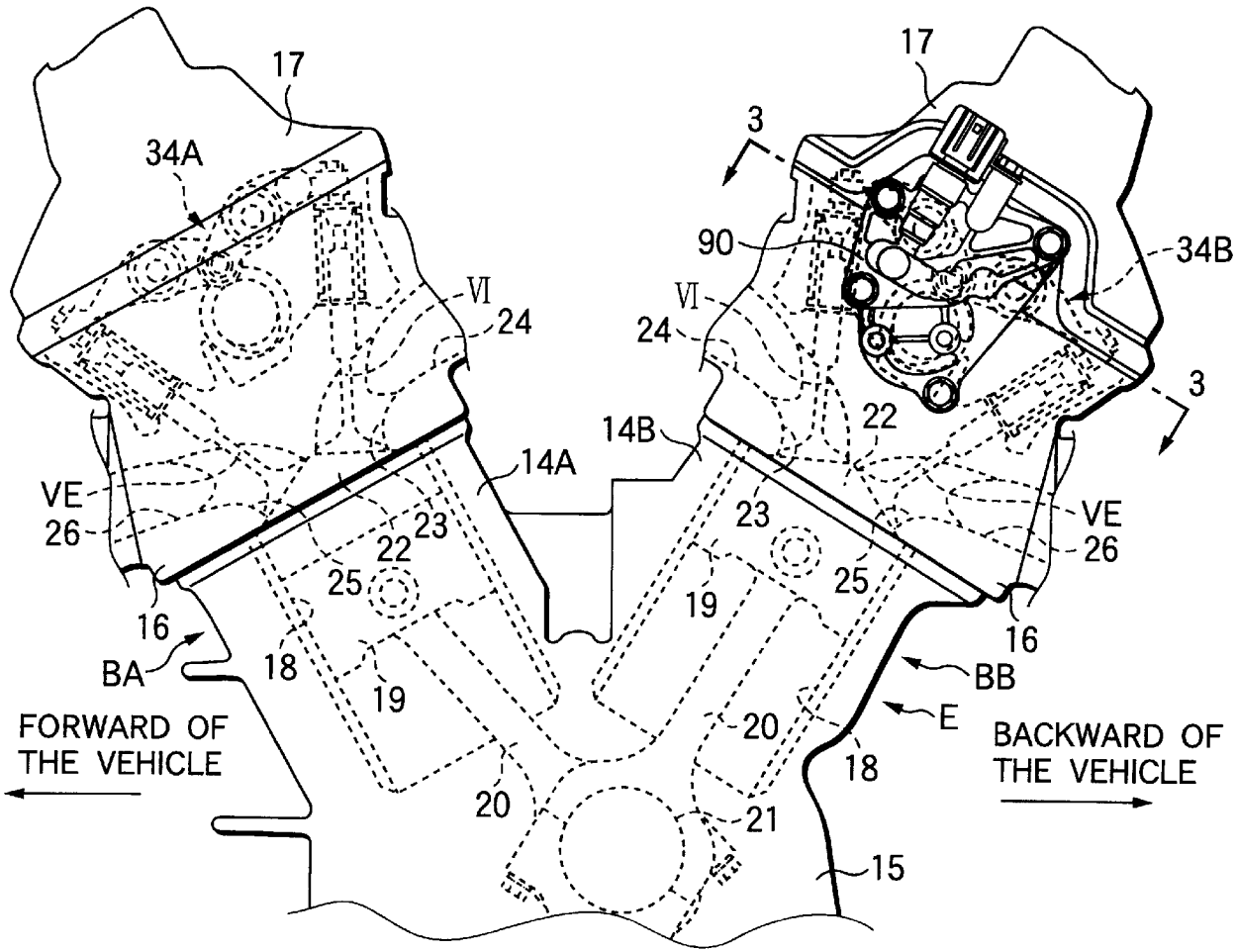
FIG. 2 is a side view of an upper portion of the multi-cylinder engine as viewed in a direction indicated by an arrow 2 in FIG. 1.
Figure 3:
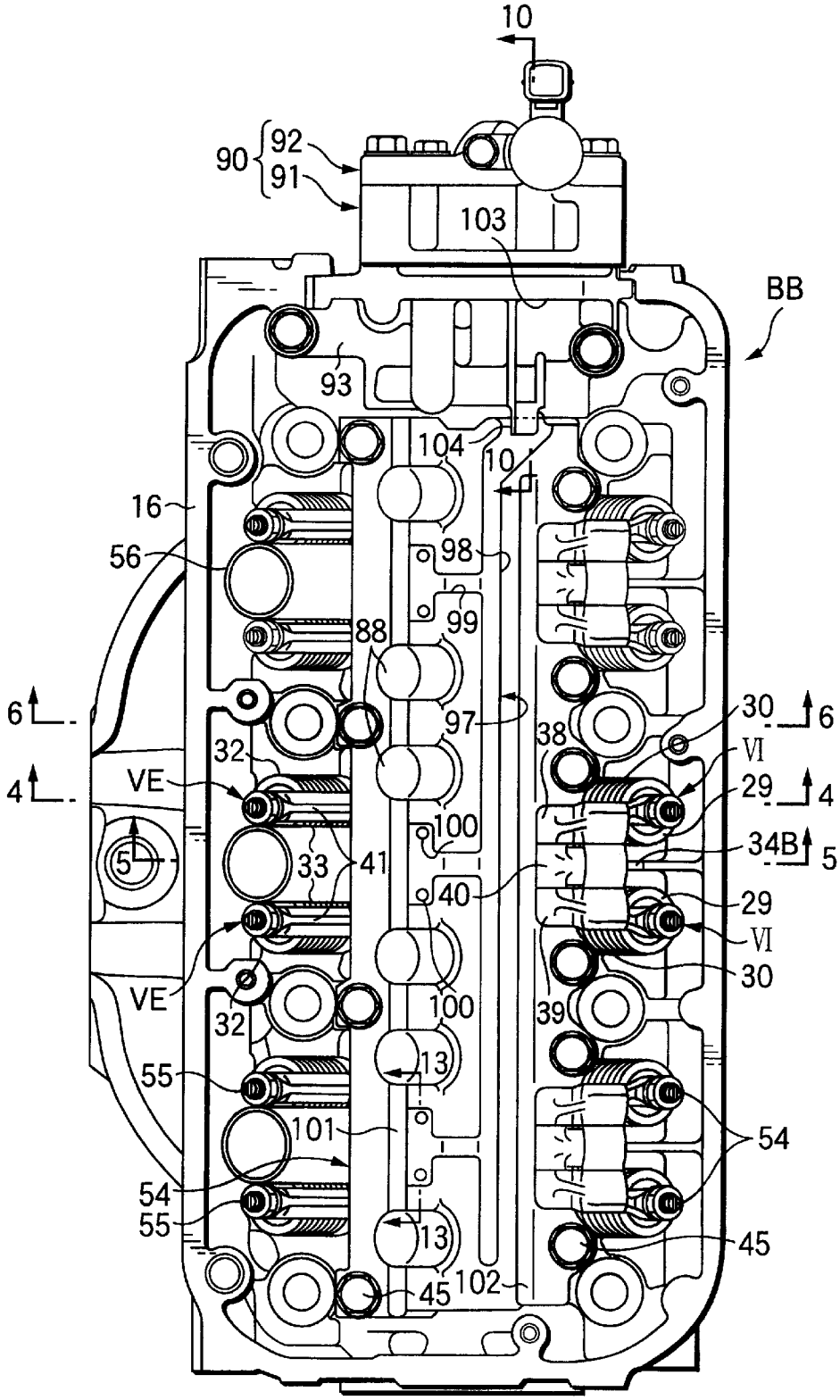
FIG. 3 is a plan view of a cylinder head taken along the line 3—3 in FIG. 2.
Figure 4:
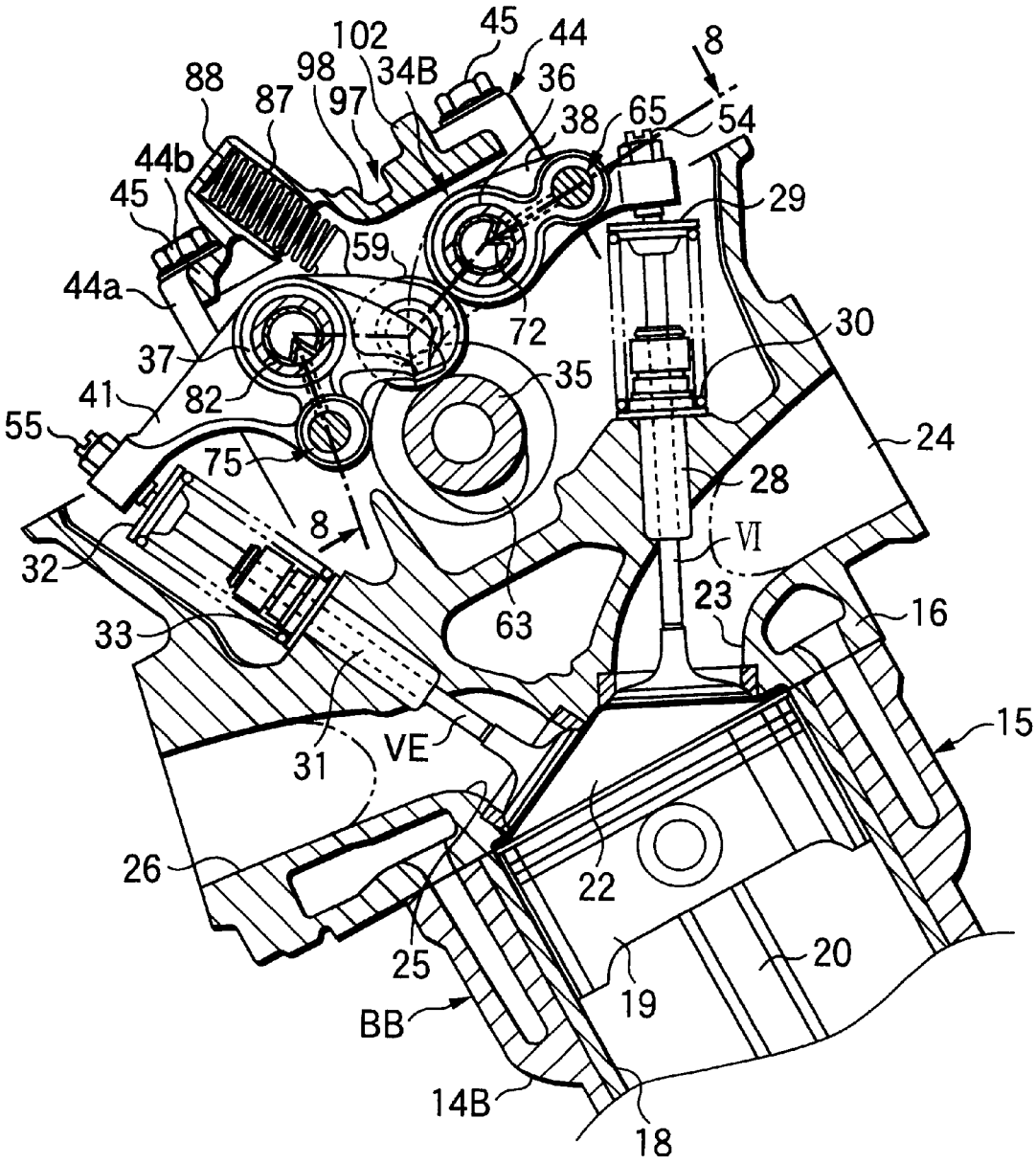
FIG. 4 is a cross-sectional view taken along the line 4—4 in FIG. 3.
Figure 5:
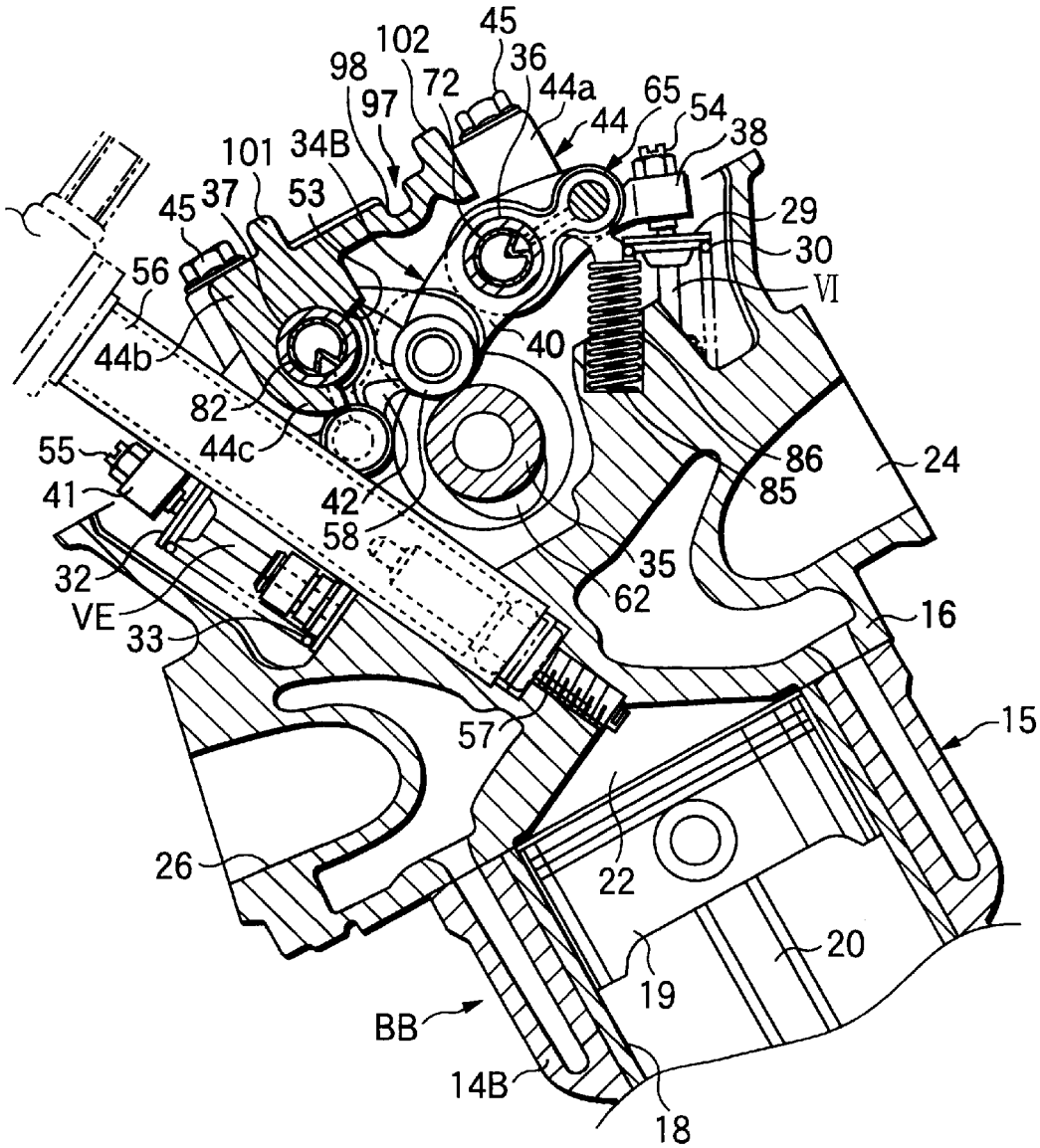
FIG. 5 is a cross-sectional view taken along the line 5—5 in FIG. 3.
Figure 6:
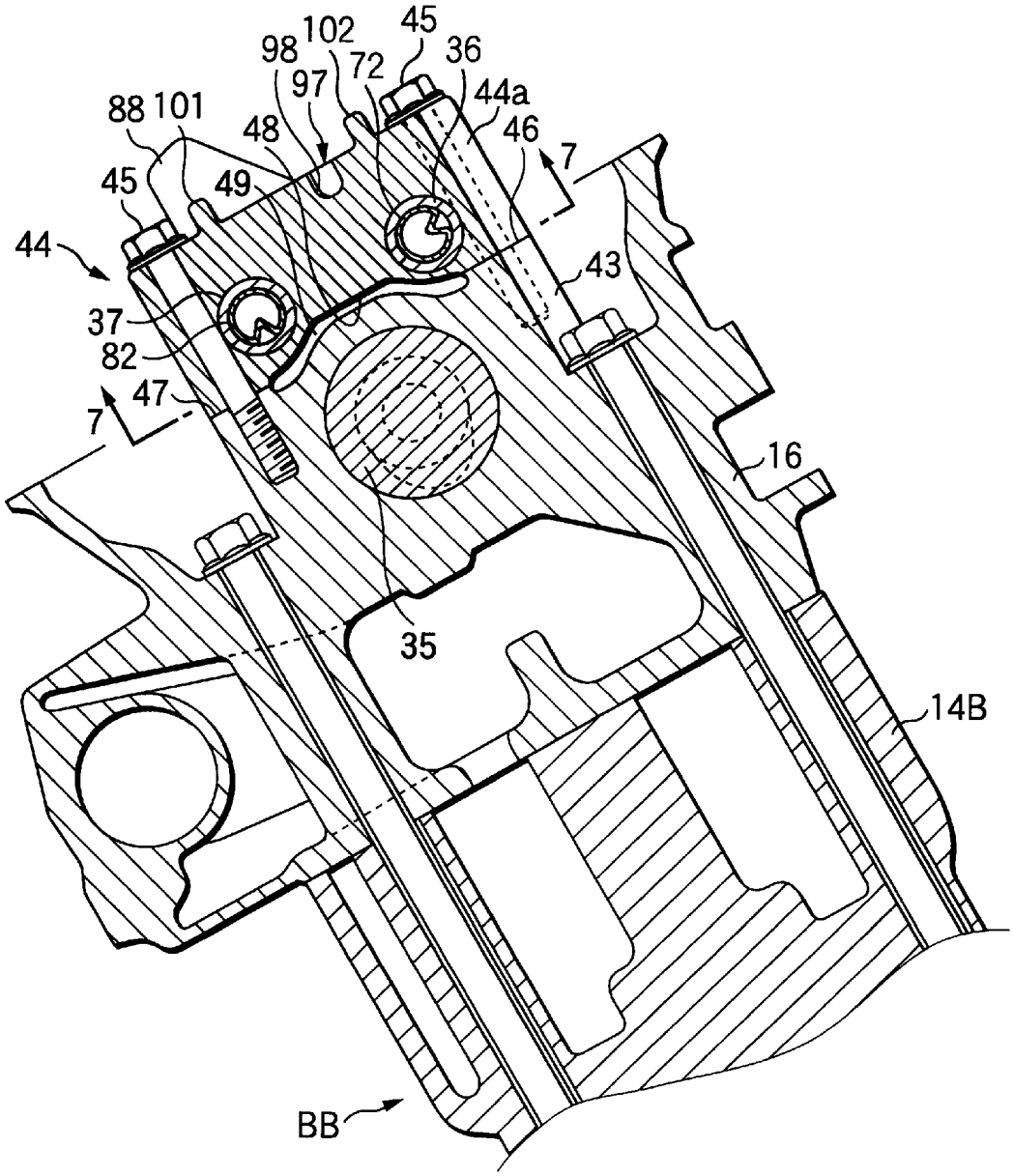
FIG. 6 is a cross-sectional view taken along the line 6—6 in FIG. 3.
Figure 7:
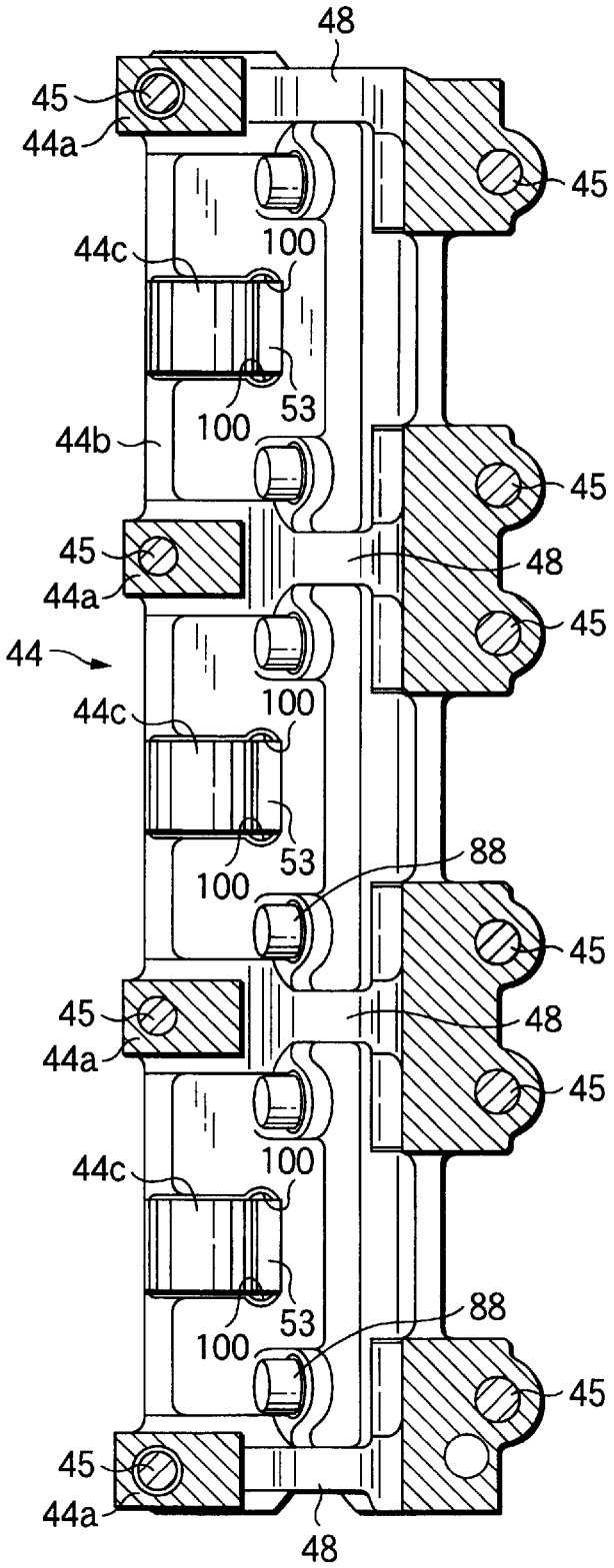
FIG. 7 is a cross-sectional view taken along the line 7—7 in FIG. 6.
Figure 8:
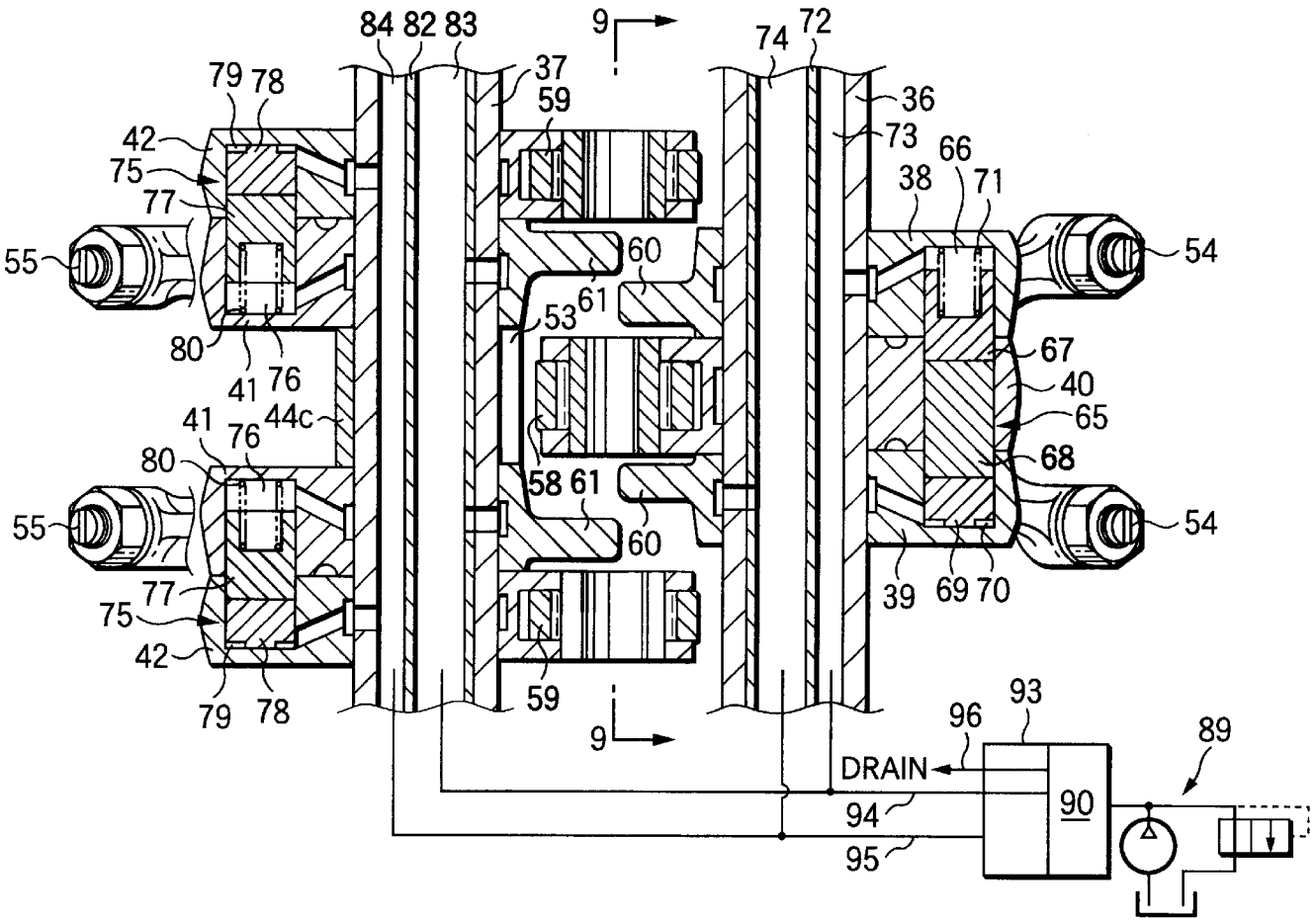
FIG. 8 is a cross-sectional view taken along the line 8—8 in FIG. 4.
Figure 9:
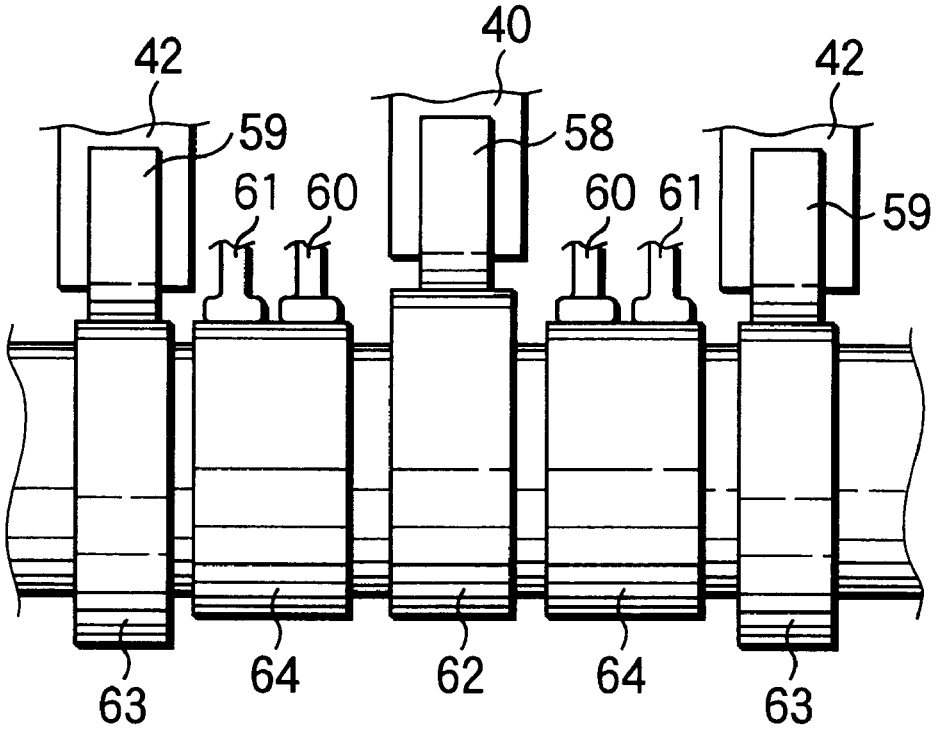
FIG. 9 is a cross-sectional view taken along the line 9—9 in FIG. 8.
Figure 10:
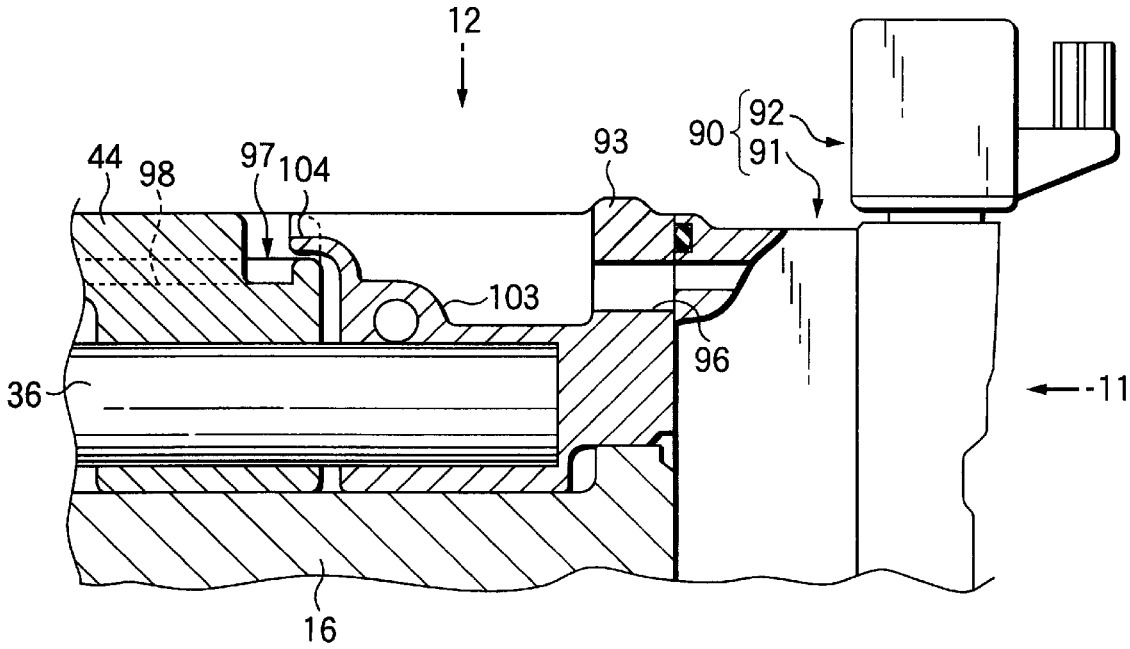
FIG. 10 is an enlarged cross-sectional view taken along the line 10—10 in FIG. 3.
Figure 11:
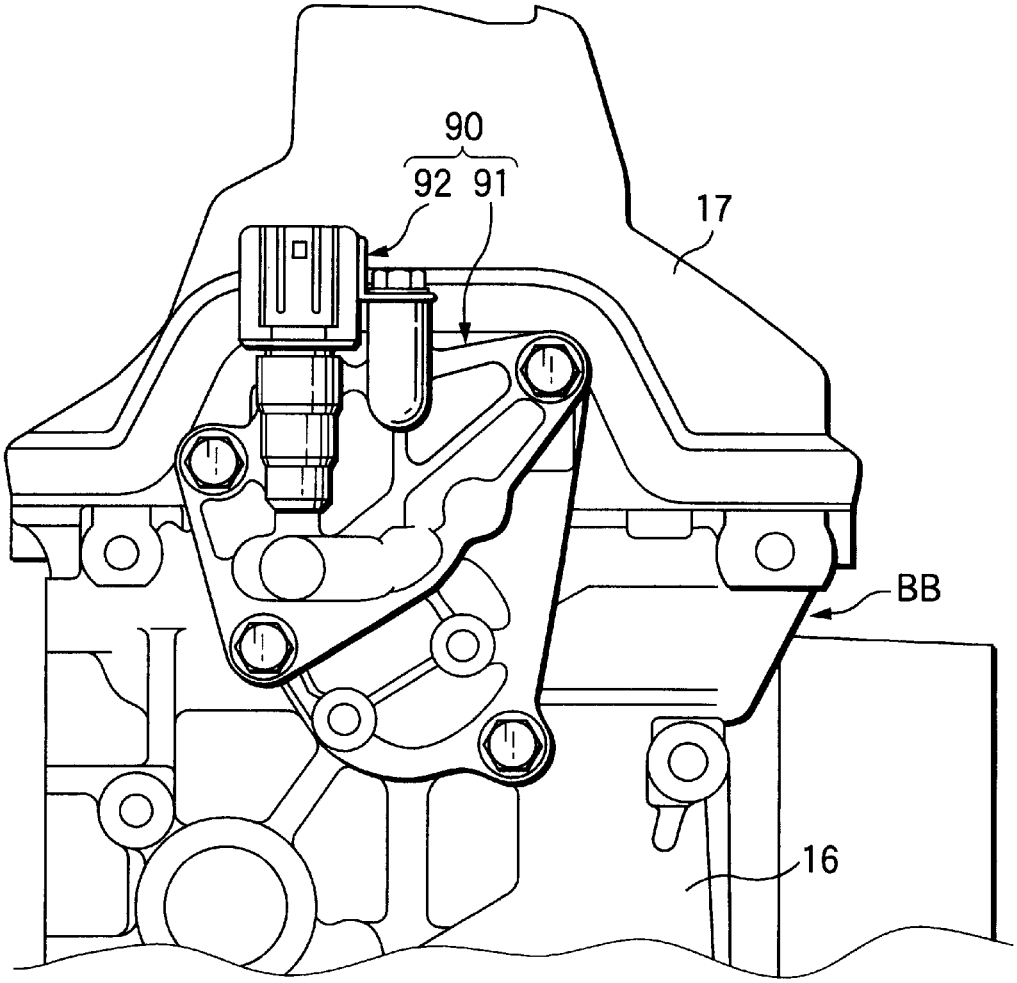
FIG. 11 is a view as seen in a direction indicated by an arrow 11 in FIG. 10 with a valve cover being mounted.
Figure 12:
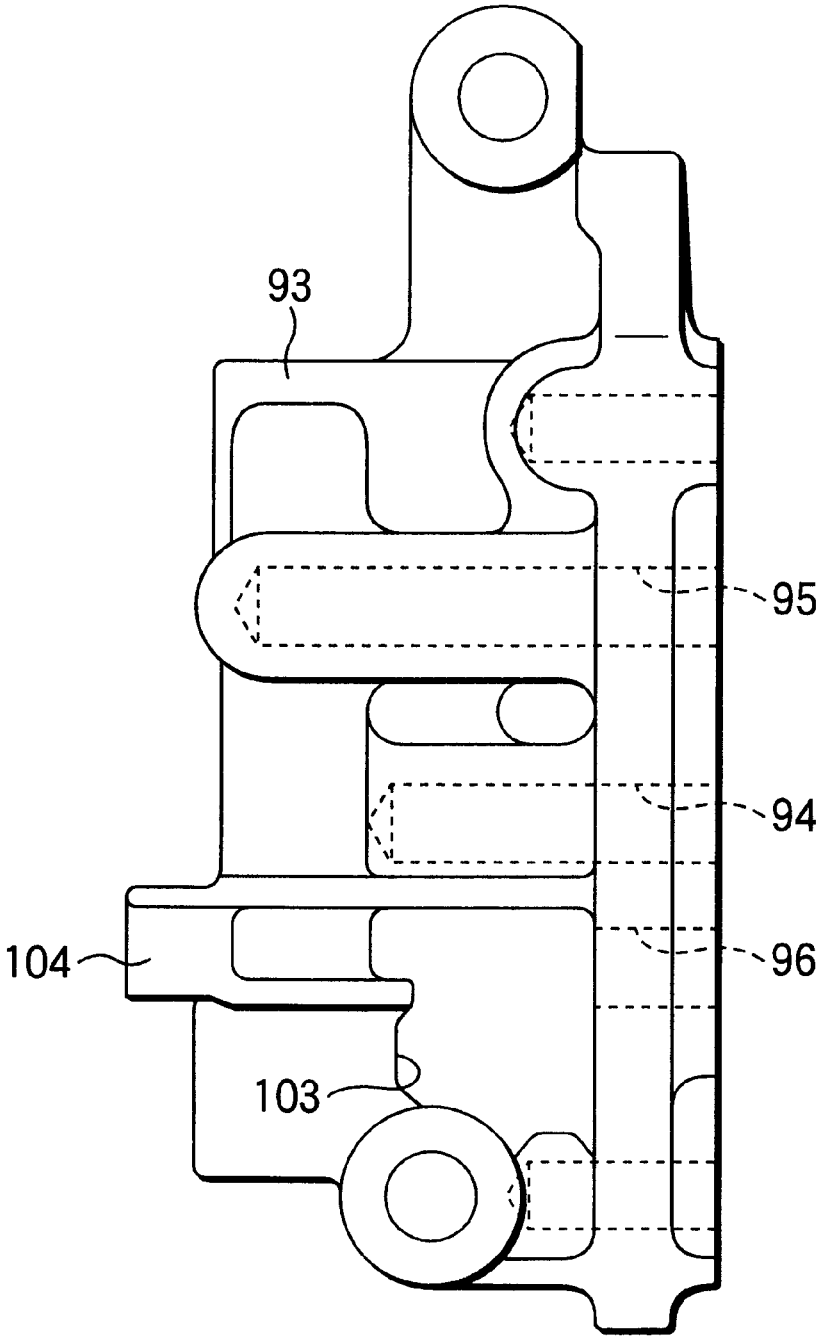
FIG. 12 is a plan view of a path forming member as viewed in a direction indicated by an arrow 12 in FIG. 10.
Figure 13:
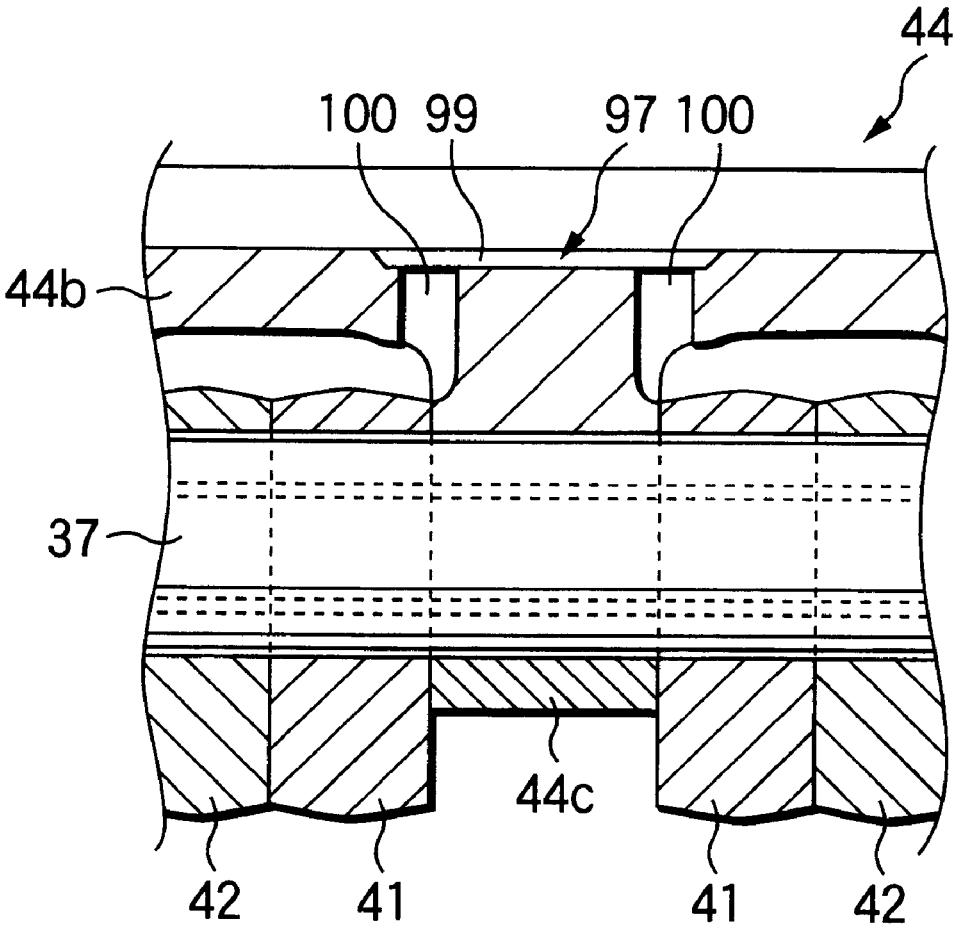
FIG. 13 is an enlarged cross-sectional view taken along the line 13—13 in FIG. 3.

FIGS. 1 to 13 show one embodiment of the invention, in which FIG. 1 is a plan view schematically showing a state in which a multi-cylinder engine is mounted on a vehicle, FIG. 2 is a side view of an upper portion of the multi-cylinder engine as viewed in a direction indicated by an arrow 2 in FIG. 1, FIG. 3 is a plan view of a cylinder head taken along the line 3—3 in FIG. 2, FIG. 4 is a cross-sectional view taken along the line 4—4 in FIG. 3, FIG. 5 is a cross-sectional view taken along the line 5—5 in FIG. 3, FIG. 6 is a cross-sectional view taken along the line 6—6 in FIG. 3, FIG. 7 is a cross-sectional view taken along the line 7—7 in FIG. 6, FIG. 8 is a cross-sectional view taken along the line 8—8 in FIG. 4, FIG. 9 is a cross-sectional view taken along the line 9—9 in FIG. 8, FIG. 10 is an enlarged cross-sectional view taken along the line 10—10 in FIG. 3, FIG. 11 is a view as seen in a direction indicated by an arrow 11 in FIG. 10 with a valve cover being mounted, FIG. 12 is a plan view of a path forming member as viewed in a direction indicated by an arrow 12 in FIG. 10, and FIG. 13 is an enlarged cross-sectional view taken along the line 13—13 in FIG. 3.

Firstly, in FIGS. 1 and 2, this multi-cylinder engine E has a pair of first and second banks BA, BB which is formed into a V-shape on a projection drawing onto a plane normal to an axial direction of a crankshaft 21 extending in a transverse direction of a vehicle V. The multi-cylinder engine E is constructed as a V-six cylinder engine. The multi-cylinder engine is mounted in an engine compartment of the vehicle V that is between left and right front wheels WL, WR behind a radiator R, so as to dispose the second bank BB rearward of the first bank BA. A transmission M is disposed between the engine E and the left front wheel WL.

The first and second banks BA, BB comprises first and second cylinder row portions 14A, 14B in an engine block 15, cylinder heads 16, 16 connected to the first and second cylinder row portions 14A, 14B, respectively, and valve covers 17, 17 connected to the cylinder heads 16, 16, respectively. Three cylinder bores 18 are formed in each of the first and second cylinder row portions 14A, 14B to be arranged in a row in a direction parallel to the axial direction of the crankshaft 21. Pistons 19 fitted sidably in the respective cylinder bores 18 are connected to the single common crankshaft 21 via connecting rods 20, respectively.

The first and second banks BA, BB are disposed so as to be offset from each other in the axial direction of the crankshaft 21, whereby a transmission M side end portion of the first bank BA is disposed at a position which is closer to the left front wheel WL by a distance L than a transmission M side of the second bank BB. Namely, as both the banks BA, BB are offsetted from each other, a space S is produced between one of the transmission M side end portions of the banks BA, BB and the transmission M which is disposed on one end side of the banks BA, BB in the axial direction of the crankshaft 21.

Referring to FIGS. 3 to 6, the construction of the engine E on the second bank BB side is described. Combustion chambers 22 are formed between the cylinder head 16 and the pistons 19 in the cylinder bores 18. In the cylinder head 16 at portions corresponding to the combustion chambers 22, respectively, there are a pair of inlet valve ports 23 communicating with the combustion chamber 22, induction ports 24 communicating commonly with the inlet valve ports 23 so as to open to one side of the cylinder head 16, a pair of exhaust valve ports 25 communicating with the combustion chamber 22 and an exhaust port 26 communicating commonly with the exhaust valve ports 25 so as to open to the other side of the cylinder head 16. In accordance with the fact that the first and second cylinder row portions 14A, 14B are formed into a V-shape, the cylinder head 16 is disposed to be inclined to one of the left- and right-hand sides of the engine in a cylinders row direction. Namely, the exhaust port 26 is inclined below the induction port 24.

Inlet valves VI, VI are engine valves adapted to open and close the inlet valve ports 23 individually. Stems of the inlet valves VI, VI are slidably fitted in guide tubes 28 provided in the cylinder head 16. Valve springs 30 adapted to bias the inlet valves VI, VI to a valve closing direction are provided between retainers 29 provided at upper end portions of the inlet valves VI, VI and the cylinder head 16. In addition, exhaust valves VE, VE are engine valves adapted to open and close the exhaust valve ports 25 individually. Stems of exhaust valves VE, VE are slidably fitted in guide tubes 31 provided in the cylinder head 16. Valve springs 33 adapted to bias the exhaust valves VE, VE to a valve closing direction are provided between retainers 32 provided at upper end portions of the exhaust valves VE, VE and the cylinder head 16.

The inlet valves VI, VI and exhaust valves VE, VE of each of the cylinder bores 18 are driven to open and close by a valve train 34B. The valve train 34B comprises a camshaft 35 having an axis parallel to the crankshaft 21, a pair of rocker shafts 36, 37 each having an axis parallel to the crankshaft 21, drive rocker arms 38, 39 and a free rocker arm 40 provided for each cylinder and rockingly supported on the rocker shaft 36, and drive rocker arms 41, 41 and free rocker arms 42, 42 provided for each cylinder and rockingly supported on the other rocker shaft 37.

For example, four bearing portions 43 are integrally provided on the cylinder head 16 to protrude therefrom at certain intervals in a cylinder arrangement direction with each of the combustion chambers 22 being interposed between the adjacent bearing portions 43. The camshaft 35 is rotatably supported on the bearing portions 43. In addition, the camshaft 35 is interlocked with and connected to the crankshaft 21 with a one to two speed reduction ratio.

The pair of rocker shafts 36, 37 are fixedly disposed above the camshaft 35. A rocker shaft holder 44 for supporting the rocker shafts 36, 37 is fixedly fastened to upper surfaces of the respective bearing portions 43.

Referring to FIG. 7, the rocker shaft holder 44 comprises shaft supporting portions 44*a* corresponding to the bearing portions 43, respectively, and connecting portions 44*b* for integrally connecting the shaft supporting portions 44*a*. The shaft supporting portions 44*a* are fastened, respectively, to the bearing portions 43 at both sides of the camshaft 35 with bolts 45.

The pair of rocker shafts 36, 37 are supported on the respective shaft supporting portions 44*a* of the rocker shaft holder 44 at a position, where the camshaft 35 is disposed below between the rocker shafts 36, 37. The rotation of the rocker shafts 36, 37 about the their own axes is prevented by the engagement of the bolts 45 for fastening the shaft supporting portions 44*a* to the bearing portions 43 with part of external surfaces of the rocker shafts 36, 37. Therefore, the rocker shafts 36, 37 are fixedly supported on the rocker shaft holder 44.

Incidentally, flat fastening seats 46, 47 to which the rocker shaft holder 44 is fastened are formed on both sides of a portion for rotatably supporting the camshaft 35 at the respective bearing portions 43. The bearing portions 43 are formed to rise higher than the fastening seats 46, 47 in a portion between both the fastening seats 46, 47.

On the other hand, accommodating recessed portions 48 for accommodating the central rising portions of the bearing portions 43 situate between both the rocker shafts 36, 37 on lower surfaces of the respective shaft supporting portions 44*a* of the rocker shaft holder 44. The central rising portions of the bearing portions 43 are allowed to protrude partially into the accommodating recessed portions 48 so as to avoid the contact with the rocker shaft holder 44. That is, in such a manner that a gap 49 is formed between the accommodating recessed portion 48 and the bearing portion 43.

Moreover, the connecting portions 44*b* of the rocker shaft holder 44 for providing connections between the respective shaft supporting portions 44*a* are formed to provide integral connections between portions corresponding to at least the accommodating recessed portions 48 of the respective shaft supporting portions 44*a*.

In addition, the rocker shafts 36, 37 are supported on the respective shaft supporting portions 44*a* of the rocker shaft holder 44. The rocker shaft 37 on the exhaust valves VE, VE side is also supported on intermediate shaft supporting portions 44*c*, which are disposed between the shaft supporting portions 44*a* and are provided integrally with the connecting portions 44*b*.

In FIG. 8, the drive rocker arms 38, 39 and the free rocker arm 40 which are mockingly supported on the rocker shaft 36 are disposed in such a manner that the free rocker arm 40 is interposed between the drive rocker arms 38, 39. Both the drive rocker arms 38, 39 are interlocked with and connected to the inlet valves VI, VI by allowing tappet screws 54, 54. The tappet screw 52, 52 are adapted to be adjustably screwed into or out of the rocker arms 38, 39, respectively, to be brought into abutment with upper ends of the inlet valves VI, VI.

In addition, the drive rocker arms 41, 41 and the free rocker arms 42, 42 which are rockingly supported on the rocker shaft 37 are disposed in such a manner that the drive rocker arm 41 and the free rocker arm 42 make a pair at positions which are spaced away from each other in the axial direction of the rocker shaft 37. The drive rocker arms 41, 41 are interlocked with and connected to the exhaust valves VE, VE by allowing tappet screws 55, 55. The tappet screws are adapted to be adjustably screwed into or out of the rocker arms 41, 41, respectively, to be brought into abutment with upper ends of the exhaust valves VE, VE.

Moreover, the intermediate shaft supporting portion 44*c* of the rocker shaft holder 44 is disposed between both the drive rocker arms 41, 41. The drive rocker arms 41, 41 are disposed to be contiguous with both sides of the intermediate shaft portion 44*c* in the axial direction of the rocker shaft 37.

In addition, plug insertion tubes 56 are mounted in the cylinder head 16 so as to be disposed between the two drive rocker arms 41, 41. Spark plugs 57 which are inserted into the plug insertion tubes 56 are screwed into the cylinder head 16 so as to face the respective combustion chambers 22.

Referring to FIG. 9, on the camshaft 35, there are a cam 62 which rolling contacts with a roller 58 rotatably supported on the free rocker arm 40 on the inlet valves VI, VI side, cams 63, 63 which rolling contact with rollers 59, 59 rotatably supported on the free rocker arms 42, 42 on the exhaust valves VE, VE side, and a pair of cams 64, 64 which sliding contact with cam slippers 60, 60 provided on the drive rocker arms 38, 39 on the inlet valves VI, VI side and cam slippers 61, 61 provided on the drive rocker arms 41, 41 on the exhaust valves VE, VE side, respectively. The respective cams 62, 63, 63, 64, 64 are disposed in such a manner that the cams 64, 64 are interposed between the cam 62 disposed centrally along the axial direction of the camshaft 35 and the respective cams 63, 63 disposed at outermost positions of the camshaft along the axial direction thereof.

Moreover, the cams 62 are provided on the camshaft 35 at positions corresponding to the intermediate shaft supporting portions 44*c* of the rocker shaft holder 44. The rollers 58 which are brought into rolling contact with the cams 62 are rotatably supported on the free rocker arms 40 on the inlet valves VI, VI side. In addition, notches 53 are formed in the intermediate shaft portions 44*c* for avoiding the interference with the rollers 58, whereby the respective intermediate shaft portions 44*c* are formed substantially into a J-shape.

The cam 62 is formed to have a cam profile to open and close the inlet valves VI, VI. The cams 63, 63 are formed to have cam profiles to open and close the exhaust valves VE, VE. The cams 64, 64 are formed so as to substantially close the inlet valves VI, VI and the exhaust valves VE, VE for rest. Consequently, the inlet valves VI, VI operate to open and close with both the drive rocker arms 38, 39 being connected to the free rocker arm 40. Whereas, the inlet valves VI, VI are put in a substantially closed and rest state, when both the drive rocker arms 38, 39 are released from connection to the free rocker arm 40. In addition, the exhaust valves VE, VE operate to open and close with the drive rocker arms 41, 41 being connected to the free rocker arms 42, 42. Whereas, the exhaust valves VE, VE are put in a substantially closed and rest state, when both drive rocker arms 41, 41 are released from connection to the free rocker arms 42, 42.

A rest mechanism 65 is provided on the drive rocker arms 38, 39 and the free rocker arm 40 on the inlet valves VI, VI side. The rest mechanism 65 functions as a valve operating characteristics changing mechanism for hydraulically switching over the drive rocker arms 38, 39 from the connection thereof to the free rocker arm 40 to the disconnection thereof from the free rocker arm 40.

The rest mechanism 65 comprises a connecting pin 67, a connecting pin 68, a pin 69 and a return spring 71. The connecting pin 67 adapts to slidably fit in the drive rocker arm 38 and the free rocker arm 40 while one end thereof is allowed to face a primary hydraulic chamber 66 formed within the driver rocker arm 38. The connecting pin 68 adapts to slidably fit in the free rocker arm 40 and the drive rocker arm 39 while one end thereof is brought into sliding contact with the other end of the connecting pin 67. The pin 69 adapts to be brought into sliding contact with the other end of the connecting pin 68 at one end thereof while the other end thereof is allowed to face a secondary hydraulic chamber 70 formed within the drive rocker arm 39. The return spring 71 accommodates in the primary hydraulic chamber 66 to be provided between the drive rocker arm 38 and the connecting pin 67.

In this rest mechanism 65, when an oil pressure is applied to the primary hydraulic chamber 66, as shown in FIG. 8, the connecting pins 67, 68 which are connected to each other and the pin 69 are moved to positions where the capacity of the secondary hydraulic chamber 70 becomes minimum. The drive rocker arm 38 and the free rocker arm 40 are connected to each other by means of the connecting pin 67 whereas the free rocker arm 40 and the drive rocker arm 39 are connected to each other by means of the connecting pin 68. On the other hand, when an oil pressure is applied to the secondary hydraulic chamber 70, the connecting pins 67, 68 which are connected to each other and the pin 69 are moved to positions where the capacity of the primary hydraulic chamber 66. Then, the primary hydraulic chamber 66 becomes minimum. A contact surface between the connecting pins 67, 68 comes to exist between the drive rocker arm 38 and the free rocker arm 40. Whereby, the drive rocker arm 38 and the free rocker arm 40 are released from connection to each other. Then, a contact surface between the connecting pin 68 and the pin 69 comes to exist between the free rocker arm 40 and the drive rocker arm 39, whereby the free rocker arm 40 and the drive rocker arm 39 are released from connection to each other.

Thus, the rest mechanism 65 changes the operating characteristics of the inlet valves VI, VI by switching over the free rocker arm 40. The switching is between the connection thereof to and disconnection thereof from the drive rocker arms 38, 39 through selective application of the oil pressure to the primary and secondary hydraulic chambers 66, 70. The return spring 71 only has to exhibit a spring force that can prevent the looseness of the respective pins 67, 68, 69 in a state. The state is that the oil pressure is applied to neither the primary hydraulic chamber 66 nor the secondary hydraulic chamber 70 in response to the halt of the operation of the engine E.

A dividing member 72 is fittingly inserted into the rocker shaft 36 for dividing the interior of the rocker shaft 36 into two. This dividing member 72 forms independently within the interior of the rocker shaft 36 a primary hydraulic oil passage 73 communicating with the primary hydraulic chamber 66 and a secondary hydraulic oil passage 74 communicating with the secondary hydraulic chamber 70.

In addition, rest mechanisms 75, 75 are provided, respectively, on the pairs of drive rocker arms 41, 41 and free rocker arms 42, 42 which are disposed adjacent to each other on the exhaust valves VE, VE side. The rest mechanisms 75, 75 functions as valve operating characteristics changing mechanisms for hydraulically switching over the drive rocker arms 41, 41 between the connection thereof to and the disconnection thereof from the free rocker arms 42, 42, respectively.

The rest mechanism 75 comprises a connecting pin 77, a pin 78 and a return spring 80. The connecting pin 77 adapts to be slidably fitted in the drive rocker arm 41 and the free rocker arm 42 while one end thereof is allowed to face a primary hydraulic chamber 76 formed within the driver rocker 41. The pin 78 adapts to be slidably fitted in the free rocker arm 42 with one end thereof being allowed to be brought into sliding contact with the other end of the connecting pin 77 while the other end thereof is allowed to face a secondary hydraulic chamber 79 formed within the free rocker arm 42. The return spring 80 accommodates in the primary hydraulic chamber 76 to be provided between the drive rocker arm 41 and the connecting pin 77.

In this rest mechanism 75, when an oil pressure is applied to the primary hydraulic chamber 76, as shown in FIG. 8, the connecting pin 77 and the pin 78 which are connected to each other are moved to positions where the capacity of the secondary hydraulic chamber 79 becomes minimum. The drive rocker arm 41 and the free rocker arm 42 are connected to each other by means of the connecting pin 77. On the other hand, when an oil pressure is applied to the secondary hydraulic chamber 79, the connecting pin 77 and the pin 78 which are connected to each other are moved to positions where the capacity of the primary hydraulic chamber 76 becomes minimum. A contact surface between the connecting pin 77 and the pin 78 comes to exist between the free rocker arm 42 and the drive rocker arm 41, whereby the free rocker arm 42 and the drive rocker arm 41 are released from connection to each other.

Thus, the rest mechanism 75 changes the operating characteristics of the exhaust valves VE, VE by switching over the connection and disconnection between the drive rocker arm 41 and the free rocker arm 42 through selective application of the oil pressure to the primary and secondary hydraulic chambers 76, 79. The return spring 80 only has to exhibit a spring force that can prevent the looseness of the respective pins 77, 78 in a state. The state is that the oil pressure is applied to neither the primary hydraulic chamber 76 nor the secondary hydraulic chamber 79 in response to the halt of the operation of the engine E.

A dividing member 82 is fittingly inserted into the rocker shaft 37 for dividing the interior of the rocker shaft 37 into two. This dividing member 82 forms independently within the interior of the rocker shaft 37 a primary hydraulic oil passage 83 communicating with the primary hydraulic chamber 76 and a secondary hydraulic oil passage 84 communicating with the secondary hydraulic chamber 79.

Incidentally, lost motion springs 85 are provided between the cylinder head 16 and the free rocker arms 40. The lost motion springs 85 exhibit spring force to press the free rocker arm 40 against the cam 62 on the camshaft 35 in a state in which the rest mechanisms 65 on the inlet valves VI, VI side releases the free rocker arm 40 from the connection to the drive rocker arms 38, 39. The lost motion springs 85 are partially accommodated, respectively, into bottomed holes 86 formed in an upper surface of the cylinder head 16.

In addition, lost motion springs 87, 87 are provided between the rocker shaft holder 44 and the free rocker arms 42, 42. The lost motion springs 87, 87 exhibit a spring force to press the free rocker arms 42, 42 against the cams 63, 63 on the camshaft 35 in a state in which the rest mechanisms 75, 75 on the exhaust valves VE, VE side release the free rocker arms 42, 42 from the connection to the drive rocker arms 41, 41, respectively. Bottomed cylindrical portions 88, 88 are integrally provided on the connecting portions 44*b* of the rocker shaft holder 44 so as to protrude upwardly from the rocker shaft holder 44 so that the lost motion springs 87 are partially accommodated therein.

Thus, there is no risk that the lost motion springs 87, 87 which are partially accommodated in the bottomed cylindrical portions 88, 88 fall from the rocker shaft holder 44 in a state. The state is that the rocker shaft 37 on which the drive rocker arms 41, 41 and the free rocker arms 42, 42 are rotatably supported is supported on the rocker shaft holder 44. The lost motion springs 87, 87 can be held on the rocker shaft holder 44 with a simple construction in which the lost motion springs 87, 87 are partially accommodated in the bottomed cylindrical portions 88, 88.

Moreover, the bottomed cylindrical portions 88, 88 are provided integrally on the rocker shaft holder 44 so as to protrude therefrom to continuous with the respective shaft supporting portions 44*a*. The rigidity of the respective shaft supporting portions 44*a* and hence of the overall rocker shaft holder 44 can be increased with these bottomed cylindrical portions 88, 88.

Referring FIGS. 10 and 11, a oil pressure control valve 90 is attached to a transmission M side end portion of the cylinder head 16 of the second bank BB. The oil pressure control valve 90 controls the oil pressure of hydraulic oil supplied to the primary hydraulic oil passages 73, 83 and the secondary hydraulic oil passages 74, 84 which are formed within the rocker shafts 36, 37, respectively. Moreover, due to the offset of the primary and secondary banks BA, BB from each other, the transmission M side end portion of the secondary bank BB faces a space S produced between end portions of both the banks BA, BB. The oil pressure control valve 90 is disposed in the space S and is attached to the cylinder head 16.

The oil pressure control valve 90 is constituted by, for example, a spool valve 91 attached to the cylinder head 16 and an electromagnetic valve 92 attached to the spool valve 91 for controlling the switching operation of the spool valve 91. The oil pressure control valve 90 is attached to the cylinder head 16 in such as to be disposed to be accommodated within the width of the cylinder head 16.

A passage forming member 93 into which one ends of the rocker shafts 36, 37 are fitted is attached onto the cylinder head 16 between the spool valve 91 and the rocker shaft holder 44. Namely, the spool valve 91 of the oil pressure control valve 90 is adapted to be attached to the cylinder head 16 and the passage forming member 93 attached in turn to the cylinder head 16, whereby the attachment rigidity of the oil pressure control valve 90 can be increased.

Referring to FIG. 12, in the passage forming member 93, there are a primary communicating oil path 94 and The secondary communicating oil path 95. The primary communicating oil path 94 provides a connection between the primary hydraulic oil passages 73, 83 in the rocker shafts 36, 37 and the spool valve 91. The secondary communicating oil path 95 provides a connection between the secondary hydraulic oil passages 74, 84 in the rocker shafts 36, 37 and the spool valve 91. As shown in FIG. 8, the spool valve 91 can be switched over between a primary condition and a secondary condition. The primary condition is that the hydraulic oil from an oil pressure source 89 including an oil pump is allowed to flow into the primary communicating oil path 94 or the primary hydraulic oil passages 73 83. The secondary condition is that the hydraulic oil from the oil pressure source is allowed to flow into the secondary communicating oil path 95 or the secondary hydraulic oil passages 74, 84.

Moreover, the spool valve 91 is constructed to discharge drain oil when a switchover between the primary and secondary conditions is implemented. A drain oil path 96 for guiding the drain oil is formed in an upper portion of the passage forming member 93.

In addition, an oil reservoir 97 is formed in an upper surface of the rocker shaft holder 44 for reserving oil scattering within a valve train chamber between the cylinder head 16 and the valve cover 17.

This oil reservoir 97 comprises a groove portion 98 and a substantially T-shaped branch groove portions 99*a*. The groove portion 98 extends along the cylinder arrangement direction. The substantially T-shaped branch groove portions 99 are disposed to be situated between the pair of bottomed cylindrical portions 88, 88 at positions corresponding to central portions of the respective combustion chambers 22 and are made continuous with the groove portion 98. In order to guide oil within the groove 98 into the branch groove portions 99, the respective branch groove portions 99 are formed so as to be continuous with a side portion on the exhaust valves VE, VE side of the groove portion 98, based on the fact that the cylinder head 16 is disposed to be inclined in such a manner that the exhaust port 26 is situated below the induction port 23.

Referring to FIG. 13, a rib 101 is provided so as to protrude from the upper surface of the rocker shaft holder 44 in such a manner as to extend in the cylinder arrangement direction. The rib 101 has a side which is situated below the groove portion 98 and becomes flush with the circumferential walls of end portions of the respective branch groove portions 99. The rib 101 is designed to connect portions of the bottomed cylindrical portions 88, 88 disposed on both the sides of the branch groove portions 99. The branch groove portions 99 are situated lower in the inclined direction in conjunction with the inclination of the cylinder head 16. The bottomed cylindrical portions 88, 88 and the rib 101 constitute part of the oil reservoir 97 and are disposed in a substantially U-shaped fashion, the rib 101 becoming a wall regulating a lowermost portion of the 99.

In addition, pairs of lubricating oil paths 100, 100 which are communicated with each other at upper ends thereof are provided in the rocker shaft holder 44 so as to pass through the connecting portions 44*b* along the side of the rib 101 on the oil reservoir 97 side. The pairs of lubricating oil paths 100, 100 are disposed at end portions of the respective branch groove portions 99 of the oil reservoir 97. The branch groove portions are closer to the rib 101 or at areas in the oil reservoir 97 which are surrounded by the bottomed cylindrical portions 88, 88 and the rib 101.

The pair of lubricating oil path 100, 100 is disposed at positions of the rocker shaft holder 44 between the intermediate shaft supporting portions 44*c*. Lubricating oil is supplied from the lubricating oil paths 100, 100 to lubricate sliding portions between the drive rocker arms 41, 41, sliding portions between the drive rocker arms 41, 41 and the rocker shaft 37 and sliding portions between the free rocker arms 42, 42. The sliding portions between the drive rocker arms 41, 41 are adjacent to the intermediate shaft supporting portions 44*c* of the rocker arms 38 to 40, 41, 42. The sliding portions between the free rocker arms 42, 42 are adjacent to the drive rocker arms 41, 41 and the rocker shaft 37.

In addition, a rib 102 sandwiching the oil reservoir 97 with the rib 101 is provided so as to protrude from the upper surface of the rocker shaft holder 44 in such a manner as to extend in the cylinder arrangement direction. Moreover, the ribs 101, 102 are provided along the full length of the rocker shaft holder 44, whereby the respective shaft supporting portions 44*a* and the respective intermediate shaft supporting portions 44*c* of the rocker shaft holder 44 are connected to each other via the respective ribs 101, 102.

Incidentally, the drain oil discharged from the oil pressure control valve 90 is also guided into the oil reservoir 97. The upper portion of the passage forming member 93 is formed in such a manner that the drain oil discharged from the oil pressure control valve 90 is delivered to the oil reservoir 97.

Namely, in the upper portion of the passage forming member 93, there are a recessed portion 103 and a substantially U-shaped guide portion 104. The recessed portion 103 is communicate with a drain oil path 96 for guiding the drain oil from the oil pressure control valve 90. The substantially U-shaped guide portion 104 is made to open upwardly so that the drain oil reserved in the recessed portion 103 is led to the oil reservoir 97 side. The guide portion 104 is extended to an upper portion of one end of the groove portion 98 in the oil reservoir 97.

The construction of the primary bank BA side of the engine E is basically the same as that of the aforethe secondary bank BB side thereof. However, the valve trains 34A for driving the inlet valves VI, VI and the exhaust valves VE, VE provided in the cylinder head 16 on the primary bank BA side are different from the valve trains 34B on the secondary bank BB side. The inlet valves VI and the exhaust valves VE cannot be closed for rest during the operation of the engine E in the secondary bank BB.

Next, the operation of this embodiment will be described. The oil pressure control valve 90 for controlling the pressure of oil to be supplied to the rest mechanisms 65, 75 incorporated in the valve trains 34B is disposed in the space S. The space S is produced between the end portions of the adjacent banks BA, BB at the one ends thereof in the axial direction of the crankshaft 21, as the primary and secondary banks BA, BB are offset from each other. The oil pressure control valve 90 is attached to the cylinder head 16 on the secondary bank BB. Therefore, there is no risk that the oil pressure valve 90 protrudes from the engine E in the axial direction of he crankshaft 21, thereby making it possible to miniaturizing the overall multi-cylinder engine E.

In addition, the space S is produced at the end of the engine where the transmission M is disposed to face the end portion of the cylinder head 16 on the second bank BB. The oil pressure control valve 90 is disposed in the space above the transmission M which is made to open upwardly, whereby the service of the oil pressure valve 90 for maintenance is facilitated.

Furthermore, the oil pressure control valve 90 is attached to the cylinder head 16 on the second bank BB at the position where the oil pressure control valve 90 is accommodated within the width of the cylinder head 16. Therefore, there is no risk that the oil pressure control valve 90 protrudes sideways from the cylinder head 16, thereby making it possible to miniaturize further the overall multi-cylinder engine E.

Moreover, the primary and secondary banks BA, BB are disposed to be separated in the longitudinal direction of the vehicle V. The valve trains 34 incorporating the rest mechanisms 65, 75 and the oil pressure control valve 90 are, respectively, disposed on and attached to only the cylinder head 16 on the secondary bank BB. The secondary bank BB is disposed rearward of the primary bank BA as viewed in the longitudinal direction of the vehicle V. Therefore, according to the construction, the oil pressure control valve 90 is disposed at the rear of the engine in the longitudinal direction of the vehicle V. In addition the cylinder head 16 on the bank BA disposed ahead of the oil pressure control valve 90 is allowed to function as the shielding wall against the running wind occurring while the vehicle V is running. Therefore, the adverse effect to the oil pressure control valve 90 by the running wind is suppressed to as low the level as possible. Namely, the decline in temperature of hydraulic oil is suppressed the pressure of which is controlled by the oil pressure control valve 90. In addition, the response of the rest mechanisms 65, 75 can be maintained high, and the length of the oil path between the rest mechanisms 65, 75 and the oil pressure control valve 90 can be reduced.

Moreover, depending upon the driving condition of engine E by actuation of the rest mechanisms 65, 75, the valve trains 34B on the secondary bank BB are adapted to operate to keep the inlet valves VI and the exhaust valves VE closed for rest. As the placement of the secondary bank BB constructed as described above is disposed at the rearward position or the position closer to the passenger compartment within the engine compartment, it is reduced the effect of engine noise to the interior of the passenger compartment that would occur in association with the operation of the multi-cylinder engine E. Therefore, the compartment contributes to the suppression of noise level within the passenger compartment to a lower level.

In addition, in the primary and secondary banks BA, BB, the bearing portions 43 which supports the camshaft 35 rotatably are provided protrusively on the cylinder head 16 at certain intervals along the cylinder arrangement direction in such a manner that each of the combustion chambers 22 is interposed between the adjacent bearing portions 43. On the other hand, the rocker shafts 36, 37 support rockingly the rocker arms 38, 39, 40; 41, 42 which are actuated in conjunction with the rotation of the camshaft 35 and are disposed above the camshaft 35. The rocker shafts 36, 37 are fixedly supported with the rocker shaft holder 44 which is fastened to the bearing portions 43, whereby the supporting rigidity of the rocker shafts 36, 37 can be increased.

The rocker shaft holder 44 comprises the shaft supporting portions 44*a* which are fastened to the bearing portions 43, respectively, and the connecting portions 44*b* which connect integrally the shaft supporting portions 44*a*. In addition, the accommodating recessed portions 48 into which the bearing portions 43 are allowed to protrude partially are formed on the lower sides of the shaft supporting portions 44*a*. Whereby, the fastening construction between the bearing portions 43 and the rocker shaft holder 44 can be made compact along the axial direction of the cylinder bores 18, thereby making it possible to avoid the enlargement of the engine E. Moreover, the connecting portions 44*b* are adapted to integrally connect at least the portions of the plurality of shaft supporting portions 44*a* which is corresponded to the accommodating recessed portions 48 to each other. Therefore the reduction in rigidity of the rocker shaft holder 44 can be avoided despite the fact that the accommodating recessed portions 48 are formed in the respective shaft supporting portions 44*a*.

In addition, the bearing portions 43 are allowed to protrude partially into the accommodating recessed portion 48 in order to avoid the contact against the rocker shaft holder 44. Therefore, the transmission of vibrations of the camshaft 35 to the rocker shafts 36, 37 via the rocker shaft holder 44 can be suppressed as much as possible.

The pair of rocker shaft 35, 37 which are parallel to each other are supported on the rocker shaft holder. The accommodating recessed portions 48 are provided on the rocker shaft holder 48 between the rocker shafts 36, 37, whereby the distance between the rocker shafts 36, 37 and the camshaft 35 can be set shorter. The fastening construction between the bearing portions 43 and the rocker shaft holder 44 can be made compact further along the axial direction of the cylinder bores 18.

The intermediate shaft supporting portions 44*c* which are disposed between the plurality of shaft portions 44*a* are provided integrally at the connecting portions 44*b* of the rocker shaft holder 44. The rocker shaft 37 of Both of the rocker shafts 36, 37 is supported on the respective shaft supporting portions 44*a*, as well as on the intermediate shaft supporting portions 44*c*, whereby the supporting rigidity of the rocker shaft 37 can be increased sufficiently.

Additionally, the notches 53 are formed in the intermediate shaft supporting portions 44*c* for avoiding the interference with the rollers 58 rotatably supported on the free rocker arms 40 on the inlet valves VI, VI side so as to face the intermediate shaft portions 44*c*. The free rocker arms 40 provided with the rollers 58 can be disposed close to the rocker shaft 37 side sufficiently despite the fact that there are provided the intermediate shaft portions 44*c*. Therefore, it is possible to construct compact the valve trains 34A, 34B including the free rockers 40 and the rocker shafts 37.

Moreover, the drive rocker arms 41, 41 on the exhaust valves VE, VE side are disposed adjacent to the intermediate shaft supporting portions 44*c* in the axial direction of the rocker shaft 37. Therefore the axial movement of the drive rocker arms 41 can be restricted by means of the intermediate shaft supporting portions 44*c*. Whereby, the necessity is obviated of exclusive components for restricting the axial movement of the drive rocker arms 41, thereby making it possible to reduce the number of components, which would otherwise be required.

The oil reservoir 97 is formed in the upper surface of the rocker shaft holder 44. The lubricating oil paths 100, 100 which communicate with the oil reservoir 97 are formed in the rocker shaft holder 44 so as to supply lubricating oil to the sliding portions of the rocker arms 41 and the free rocker arms 42, and the sliding portions between the intermediate shaft supporting portions 44*c* and the drive rocker arms 41. The rocker arms 41 and the free rocker arms 42 are part of the respective rocker arms 38 to 40, 41 and 42 with the rocker shaft 37. Therefore, it is ensured that lubricating oil reserved in the oil reservoir 97 can be supplied via the lubricating oil paths 100, 100 to the sliding portions of the drive rockers 41 and the free rockers 42 with the rocker shaft 37 so that the sliding portions can be lubricated positively. It is also ensured that lubricating oil reserved in the oil reservoir 97 can be supplied via the lubricating oil paths 100, 100 to the sliding portions between the intermediate shaft supporting portions 44*c* and the drive rockers 41 so that the sliding portions can be lubricated positively. Consequently, there is no need to provide exclusive components for lubricating the sliding portions of the drive rocker arms 41 and the free rocker arms 42. There is no need to provide exclusive components for lubricating the sliding portions between the intermediate shaft supporting portions 44*c* and the drive rocker arms 41. Whereby, the respective sliding portions can be lubricated while avoiding the increase in number of components. Moreover, the oil reservoir 97 is formed in the upper surface of the rocker shaft holder 44, and therefore the machining of the oil reservoir 97 can be facilitated.

The oil reservoir 97 which is formed in the upper surface of the rocker shaft holder 44 comprises the groove portion 98 extending in the cylinder arrangement direction and the branch groove portions 99 which are made to be continuous with the groove portion 98. The rib 101 is provided protrusively on the rocker shaft holder 44 so as to extend along the cylinder arrangement direction. The rib 101 has the side surface, which is level with and continues to the circumferential walls of the end portions of the respective branch grooves 99 of the circumferential walls of the oil reservoir 97. The lubricating oil paths 100, 100 are formed in the rocker shaft holder 44 so as to communicate with the portion of the oil reservoir 97 to pass through the rocker holder 44 along the side surface of the rib 101 on the oil reservoir side. The oil reservoir 97 is closer to the rib 101 (the end portion of the branch groove 99 in this embodiment) at the upper ends thereof. Consequently, the oil in the oil reservoir 97 can be supplied to the respective cylinders, while the reduced rigidity of the rocker shaft holder 44 due to the formation of the lubricating oil paths can be compensated for.

The cylinder head 16 is disposed in an inclined fashion such that the exhaust port 26 is situated lower than the induction port 24. The rib 101 is provided protrusively on the upper surface of the rocker shaft holder 44 below the groove portion 98. Thus, the rib 101 which increases the rigidity of the rocker shaft holder 44 is allowed to function as the wall to regulate the lower portion of the oil reservoir 97, whereby as much oil as possible can be reserved positively in the upper surface of the rocker shaft holder 4.

Additionally, the rocker shaft portions 44 are provided on the bottomed cylindrical portions 88 for accommodating therein the lost motion springs 87. The lost motion springs 87 bias the free rocker arms 42 on the exhaust valves VE, VE side toward the cam 63 side of the camshaft 35. The rib 101 adapts to establish connections between the bottomed cylindrical portions 88 below the cylinder head 16 in an inclined direction, whereby a part of the oil reservoir 97 is constituted by the respective bottomed cylindrical portions 88 and the rib 101. Consequently, the rigidity of the rocker shaft holder 44 can be increased by the bottomed cylindrical portions 88 and the rib 101, and part of the oil reservoir 97 can be formed on the upper surface of the rocker shaft holder 44. Especially in this embodiment, the rigidity of the rocker shaft holder 44 can be increased further by connecting the bottomed cylindrical portions 88, 88 and the rib 101 in the substantially J-shape.

Furthermore, the lubricating oil paths 100, 100 are formed in the rocker shaft holder 44 so as to communicate with the oil reservoir 97 at the upper ends thereof in the areas surrounded by the bottomed cylindrical portions 88 and the rib 101. As the upper ends of the lubricating oil paths 100, 100 are constructed so as to communicate with the rigidity increased portions, the reduction in rigidity of the rocker shaft holder 44 can be avoided which would otherwise occur.

In addition, the rib 102 is provided protrusively on the upper surface of the rocker shaft holder 44 so that the oil reservoir 97 is interposed between the rib 101 and itself. Whereby, the rigidity of the rocker shaft holder 44 and hence the supporting rigidity of the rocker shafts 36, 37 can be increased by the rib 102 as well.

Furthermore, the ribs 101, 102 are adapted to provide connections between the respective shaft supporting portions 44*a* and the intermediate shaft supporting portions 44*c* of the rocker shaft holder 44, and therefore the rigidity of the rocker shaft holder 44, in particular, the rigidity of the intermediate shaft portions 44*c*. Hence, the supporting rigidity of the rocker shaft 37 can be increased further.

Incidentally, the cylinder head 16 on the secondary bank BB is attached to the oil pressure control valve 90 for controlling the pressure of hydraulic oil. The hydraulic oil is supplied to the rest mechanisms 65 provided on the respective rocker arms 38 to 40 on the inlet valves VI, VI side and the rest mechanisms 75 provided on the rocker arms 41, 42 on the exhaust valves VE, VE side. Therefore, the drain oil discharged from the oil pressure control valve 90 is led to the oil reservoir 97. Consequently, the drain oil discharged from the oil pressure control valve 90 can also be used to lubricate the sliding portions of the rocker arms 41, 42 on the exhaust valves VE, VE side. Whereby, the necessity is obviated of providing other specific lubricating oil paths. Moreover, the oil pressure control valve 90 is adapted to discharge the drain oil only when the operations of the rest mechanisms 65, 75 are switched over. Whereby, there is no risk that a reduction in the pressure of the oil supplied to the rest mechanisms 65, 75 is caused or that the response of the oil pressure control valve 90 is reduced by using the drain oil as lubricating oil.

Additionally, the passage forming member 93 is interposed between the oil pressure control valve 90 and the rocker shaft holder 44. The passage forming member 93 has the primary and secondary communicating passages 94, 95 for providing communications between the primary hydraulic oil passages 73, 83 and the secondary hydraulic oil passages 74, 84 which are formed in the rocker shafts 36, 37, respectively. The upper portion of the passage forming member 93 makes it possible to deliver the drain oil to the oil reservoir 97. Consequently, there is no need to provide exclusive components for delivering the drain oil between the oil pressure control valve 90 and the oil reservoir 97.

Furthermore, the upper portion of the passage forming portion 93 are provided in the recessed portion 103 for receiving the drain oil from the oil pressure valve 90, and the guide portion 104 for guiding the drain oil accumulated in the recessed portion 93 to the oil reservoir 97 side. The guide portion 104 is extended from the passage forming member 93 as far as to the upper portion at one end of the groove portion 98 in the oil reservoir 97. Thus, it is ensured that the drain oil can be delivered from the passage forming member 93 to the oil reservoir 97 of the rocker shaft holder 44, whereby a sufficient amount of drain oil can be supplied to the oil reservoir 97 of the rocker shaft holder 44. Therefore it makes possible to attain sufficient lubrication by supplying the sufficient amount of drain oil to the oil reservoir 97.

Thus, while the embodiment of the invention has been described heretofore, the invention is not limited to the embodiment but may be modified variously in design without departing from the scope of the claims of the invention.

Thus, according to the first aspect of the invention, the oil pressure control valve is disposed so as not to protrude from the engine in the axial direction of the crankshaft, whereby the overall multi-cylinder engine can be miniaturized.

In addition, according to the second aspect of the invention, the oil pressure control valve is disposed in the space above the transmission which is made to open upwardly, whereby the service of the oil pressure control valve for maintenance is facilitated.

According to the third aspect of the invention, the oil pressure control valve is disposed so as not to protrude sideways from the cylinder head, whereby the overall multi-cylinder engine can be miniaturized further.

According to the fourth aspect of the invention, the response of the valve operating characteristics changing mechanisms can be maintained high, and the length of the oil path between the valve operating characteristics changing mechanisms the oil pressure control valve can be reduced.

What is claimed is:

1. A vehicle multi-cylinder engine comprising:

a plurality of banks, each including a cylinder row portion having a plurality of cylinder bores arranged in a row and provided in an engine block, and a cylinder head connected to said cylinder row portion, wherein said plurality of banks are setted at an angle relative to each other on a projection drawing onto a plane normal to an axial direction of a crankshaft and are disposed to be offset from each other in an axial direction of said crankshaft;

valve trains provided on said cylinder heads of said respective banks, for driving engine valves for said cylinder bores, respectively, to open and close; and valve operating characteristics changing mechanisms incorporated in said valve trains of at least one of said respective banks, and being adapted to change operating characteristics of said engine valves in response to oil pressure control implemented by an oil pressure control valve;

wherein said oil pressure control valve is disposed in a space produced between end portions of said contiguous banks at either of ends thereof in an axial direction of said crankshaft as said banks are offset from each other and said oil pressure control valve is attached to at least one of said cylinder heads;

wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

2. The vehicle multi-cylinder engine as set forth in claim 1, wherein said oil pressure control valve is disposed in said space which is produced at an end side of said engine and is adjoined to a transmission.

3. The vehicle multi-cylinder engine as set forth in claim 2, wherein said oil pressure control valve is attached to said cylinder head in a range of a width thereof.

4. The vehicle multi-cylinder engine as set forth in claim 3, wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

5. The vehicle multi-cylinder engine as set forth in claim 2, wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

6. The vehicle multi-cylinder engine as set forth in claim 1, wherein said oil pressure control valve is attached to said cylinder head in a range of a width thereof.

7. The vehicle multi-cylinder engine as set forth in claim 6, wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

8. A vehicle multi-cylinder engine comprising:

a plurality of banks, each including respectively a cylinder row portion having a plurality of cylinder bores arranged in a row and provided in an engine block, and a cylinder head connected to said cylinder row portion, wherein said plurality of banks are setted at an angle relative to each other on a projection drawing onto a plane normal to an axial direction of a crankshaft and are disposed to be offset from each other in an axial direction of said crankshaft;

valve trains provided on said cylinder heads of said respective banks, for driving engine valves for said cylinder bores, respectively, to open and close; and valve operating characteristics changing mechanisms incorporated in said valve trains of at least one of said respective banks, and being adapted to change operating characteristics of said engine valves in response to oil pressure control implemented by an oil pressure control valve;

wherein said oil pressure control valve is disposed on a side face of at least one of said banks in a direction in which cylinders are arranged, and in a space produced between end portions of said contiguous banks at either of ends thereof in an axial direction of said crankshaft as said banks are offset from each other;

wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

9. The vehicle multi-cylinder engine as set forth in claim 8, wherein said oil pressure control valve is disposed in said space which is produced at an end side of said engine and is adjoined to a transmission.

10. The vehicle multi-cylinder engine as set forth in claim 9, wherein said oil pressure control valve is attached to said cylinder head in a range of a width thereof.

11. The vehicle multi-cylinder engine as set forth in claim 10, wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

12. The vehicle multi-cylinder engine as set forth in claim 9, wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

13. The vehicle multi-cylinder engine as set forth in claim 8, wherein said oil pressure control valve is attached to said cylinder head in a range of a width thereof.

14. The vehicle multi-cylinder engine as set forth in claim 13, wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

15. The vehicle multi-cylinder engine as set forth in claim 7, wherein said oil pressure control valve is attached to said cylinder head in a range of a width thereof.

16. The vehicle multi-cylinder engine as set forth in claim 14, wherein said oil pressure control valve is disposed in said space which is produced at an end side of said engine and is adjoined to a transmission.

17. The vehicle multi-cylinder engine as set forth in claim 16, wherein said oil pressure control valve is attached to said cylinder head in a range of a width thereof.

18. The vehicle multi-cylinder engine as set forth in claim 14, wherein said oil pressure control valve is attached to said cylinder head in a range of a width thereof.

19. A vehicle multi-cylinder engine comprising:

a plurality of banks, each including respectively a cylinder row portion having a plurality of cylinder bores arranged in a row and provided in an engine block, and a cylinder head connected to said cylinder row portion, wherein said plurality of banks are setted at an angle relative to each other on a projection drawing onto a plane normal to an axial direction of a crankshaft and are disposed to be offset from each other in an axial direction of said crankshaft;

valve trains provided on said cylinder heads of said respective banks, for driving engine valves for said cylinder bores, respectively, to open and close; and valve operating characteristics changing mechanisms incorporated in said valve trains of at least one of said respective banks, and being adapted to change operating characteristics of said engine valves in response to oil pressure control implemented by an oil pressure control valve;

wherein said oil pressure control valve is disposed outside of the valve trains face of at least one of said banks and a side face of said cylinder head in a direction in which cylinders are arranged, and in a space produced between end portions of said contiguous banks at either of ends thereof in an axial direction of said crankshaft as said banks are offset from each other;

wherein said oil pressure control valve is attached to said cylinder head in a range of a width thereof.

20. The vehicle multi-cylinder engine as set forth in claim 19, wherein said oil pressure control valve is disposed in said space which is produced at an end side of said engine and is adjoined to a transmission.

21. The vehicle multi-cylinder engine as set forth in any of claim 20, wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure control valve are, respectively, disposed on only said cylinder head of one bank of said banks situated on a rear side of said engine as viewed in a longitudinal direction of said vehicle.

22. The vehicle multi-cylinder engine as set forth in claim 19, wherein the pair of banks are formed in a V-shape on a projection drawing onto a plane that is normal to axial direction of said crankshaft extending in a transverse direction of a vehicle, and said valve trains incorporating said valve operating characteristics changing mechanisms and said oil pressure valve are, respectively, disposed on only said cylinder head of one bank of said banks situated on a rear side of said engine as viewed in a longitudinal direction of said vehicle.

* * * * *